US008381355B2

(12) United States Patent
Pacini

(10) Patent No.: US 8,381,355 B2
(45) Date of Patent: Feb. 26, 2013

(54) ADJUSTABLE HINGE

(75) Inventor: Sergio Pacini, Montecarlo (IT)

(73) Assignee: Euroinvest S.p.A., Lucca (IT)

( * ) Notice: Subject to any disclaimer, the term of this patent is extended or adjusted under 35 U.S.C. 154(b) by 323 days.

(21) Appl. No.: 12/586,244

(22) Filed: Sep. 19, 2009

(65) Prior Publication Data

US 2011/0041288 A1 Feb. 24, 2011

(30) Foreign Application Priority Data

Sep. 19, 2008 (IT) ..... FI2008A0180

(51) Int. Cl.
*E05D 7/06* (2006.01)

(52) U.S. Cl. ..... 16/240

(58) Field of Classification Search ..... 16/240, 16/242, 245–246, 344
See application file for complete search history.

(56) References Cited

U.S. PATENT DOCUMENTS

| | | | | |
|---|---|---|---|---|
| 679,377 | A * | 7/1901 | Hibbard | 16/240 |
| 1,157,548 | A * | 10/1915 | Katzenberger | 16/240 |
| 4,748,717 | A * | 6/1988 | Osborne | 16/240 |
| 6,397,432 | B1 * | 6/2002 | di Vinadio | 16/242 |

FOREIGN PATENT DOCUMENTS

| | | |
|---|---|---|
| EP | 0467075 A1 | 6/1991 |
| EP | 0837206 A2 | 4/1998 |
| EP | 1061221 A1 | 12/2000 |

OTHER PUBLICATIONS

European Patent Office—Search Report and Opinion—regarding IT FI20080180, dated Sep. 19, 2008.

* cited by examiner

*Primary Examiner* — Victor Batson
*Assistant Examiner* — Matthew Sullivan
(74) *Attorney, Agent, or Firm* — Pollack, P.C.

(57) ABSTRACT

An adjustable hinge is disclosed, which comprises: a) two hinge bodies for attachment, respectively, to a window or door frame and a window or door leaf; b) a rotating pin suitable for mutually articulating the hinge bodies; and c) a member for adjusting shared positions of the hinge bodies in a direction generally perpendicular to the axis of the pin. The adjustment member includes a sleeve, associated axially with the pin, which defines an external lateral coupling surface with a corresponding housing defined in a first of the hinge bodies. The sleeve is pivotally engaged with the housing such that, while remaining in relatively continuous contact with the walls of the cavity during rotation to change its position, it may occupy substantially any position required along a limited length in the perpendicular adjustment direction. A reversible locking member is also provided for locking the sleeve in selected positions it occupies inside the housing upon application of a thrusting force in a defined or selected locking direction. The sleeve has at least three distinct points of contact with the walls of the housing spaced angularly relative to one another. When the locking member is engaged, at at least two of the distinct points a thrusting force is exerted, in directions incident to one another, on respective points of the walls so as to accommodate for slack upon coupling of the sleeve and housing in directions generally incident to one another.

10 Claims, 5 Drawing Sheets

ADJUSTABLE HINGE

FIELD OF THE INVENTION

This disclosure relates generally to construction and, more particularly, to hinges for doors, windows or the like.

BACKGROUND OF THE INVENTION

In the construction of buildings and homes, in general, it is often expedient, upon the addition of doors and windows, to use revolving hinges that allow for adjustment of the shared positions of the fixed or stationary frame and mobile frame (or leaf), especially with doors and windows that are relatively heavy or large in size. Specifically, this adjustment compensates for any bending of the door or window assembly, and/or enables proper operation, even in the case of orthogonal imperfections in the door or window relative to its respective horizontal plane.

Generally speaking, the hinge allows for three possible adjustments: two adjustments of the mutual positions of the hinge bodies, i.e., in two directions crosswise to the axis of the hinge pin, and one vertical adjustment of the mutual positions of the hinge bodies in the hinge axis direction. The crosswise adjustments include one in a substantially "lateral" direction parallel to the plane of the door or window, and one direction orthogonal to the plane, such adjustments allowing the correct pressure to be provided on the closure seal around the door or window.

Conventional hinges do not typically allow for independent crosswise adjustments. At most, the mutual positions of the hinge bodies can only be adjusted in both directions simultaneously, which limits the actual range of allowable adjustments.

One type of adjustable hinge comprises an upper hinge body and a lower hinge body connected to one another by a revolving hinge pin. The upper body has a housing for insertion of the revolving pin. Inserted between the pin and inside walls of the housing is a sleeve positioned off-center from the axis of the hinge pin. This sleeve is suitably narrower in dimensions than the housing so as to enable its insertion therein, while being in continuous contact with the walls of the housing, whatever position the sleeve occupies therein. The sleeve also has a base block at the top with a toothed lateral surface for engaging position reference points on the housing walls.

For crosswise adjustment of the position of the hinge bodies, the sleeve with the pin is first raised and rotated suitably by an amount corresponding to the translation desired by the user, given the eccentricity between the sleeve and the pin. The sleeve is then lowered such that the toothed surface engages the corresponding reference points on the housing. To lock the sleeve in position inside the housing, it is pushed forward forcefully so as to hold the base block against the corresponding housing reference points.

Although useful, such a hinge structure has not only been found complicated, but also, given that the position of the sleeve and, consequently, the pin is defined by the toothed surface, it does not allow for continuous crosswise adjustments.

Moreover, recovery of slack in the coupling between the sleeve and the housing has not been found particularly effective, such being left to the force exerted on the base block which is not entirely integral with the sleeve. Because slack can lead to faulty operation of the door or window and increase the risk of breakage, it is considered important that slack be avoided.

Another conventional hinge arrangement utilizes an upper hinge body including a housing for a sleeve integral with the head of a pin rotatably engaged inside the hinge. This sleeve is also positioned off-center from the pin axis and, in practical terms, operates as a cam in contact with the walls of the housing at four points spaced at 90° angles to one another, i.e., at the vertices of a cross. The sleeve-housing coupling is such that, once the sleeve is rotated (the pin being constrained from movement otherwise to the translation of the lower hinge body), the housing moves as a function of the eccentricity in the crosswise direction of adjustment. Once the adjustment has been made, the sleeve is pushed forward forcefully against the surface of the housing by a locking dowel. The thrusting action of the dowel coincides with a line passing through two points corresponding to opposite points of contact between the sleeve and the housing. Although this force enables the sleeve and, consequently, also the pin to be locked in position relative to the upper body of the hinge, it does not take up slack in the coupling between the housing and the sleeve. Indeed, slack is taken up in one direction only, i.e., that of the force applied, and not in a direction orthogonal thereto, making recovery in only one direction ineffective.

OBJECTS AND SUMMARY OF THE INVENTION

Accordingly, it is an object of this disclosure to provide an adjustable hinge for doors and windows that effectively compensates for slack upon coupling of the hinge components so as to avoid any malfunction or breakage.

It is another object of the disclosure to provide a hinge for doors and windows that is suitable for use even with heavy or large doors and windows, that provides progressive linear adjustments that are independent of one another and, more particularly, linear lateral adjustment that does not induce perpendicular translation, perpendicular adjustment for enabling the appropriate amount of pressure to be exerted on the seal around the door or window, and vertical adjustment for achieving the desired distance from the floor.

It is a further object of the disclosure to provide a hinge with an adjustment device that is readily accessible.

According to one aspect of the disclosure, an adjustable hinge is provided, which comprises: a plurality of hinge bodies for attachment to a fixed frame and to a mobile frame, respectively, of a door or window; a revolving pin for pivotally connecting the hinge bodies to one another; and a member for adjusting shared positions of the hinge bodies in a direction generally perpendicular to the axis of the pin. The adjustment member has a sleeve, associated axially with the pin, defining an external lateral surface for coupling with a corresponding housing defined in a first of the hinge bodies. The sleeve is pivotal inside the housing such that, while it remains in relatively constant contact with the walls of the housing during its rotation to change position, it may occupy substantially any position required along a limited length of the perpendicular adjustment direction. In addition, a reversible locking member is provided for locking the sleeve in the positions it occupies inside the housing upon application of a thrusting force in a selected locking direction. The sleeve has at least three distinct portions of contact with the walls of the housing, spaced angularly from one another, and when the locking member is engaged, at at least two of the distinct contact points a thrusting force is exerted, in a direction incident to one another, on respective portions of the walls so as to accommodate for slack between the sleeve and the housing in incident directions.

BRIEF DESCRIPTION OF THE DRAWINGS

A specific, illustrative adjustable hinge, according to the disclosure, is described below with reference to the accompanying drawings, in which.

The same numerals are used throughout the drawing figures to designate similar elements. Still other objects and advantages of the disclosure will become apparent from the following description of the preferred embodiments.

DETAILED DESCRIPTION OF THE PREFERRED EMBODIMENTS

Figure 1:
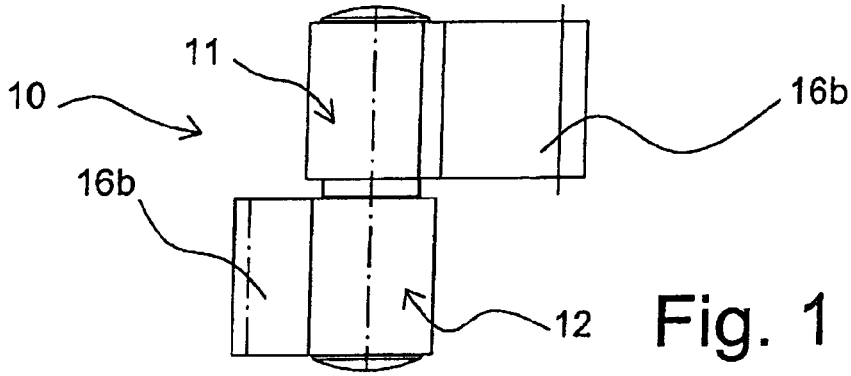
FIG. 1 is a front view of a hinge, according to one aspect of the disclosure.
Figure 2:
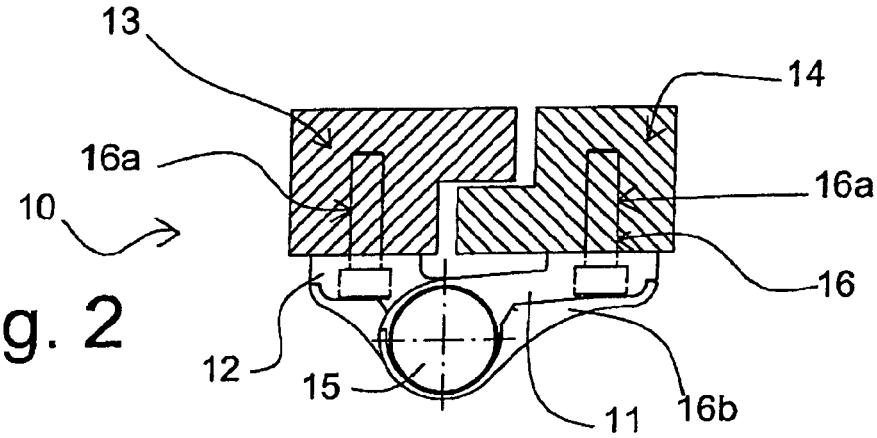
FIG. 2 is a plan view of the hinge illustrated in FIG. 1.
Figure 3:
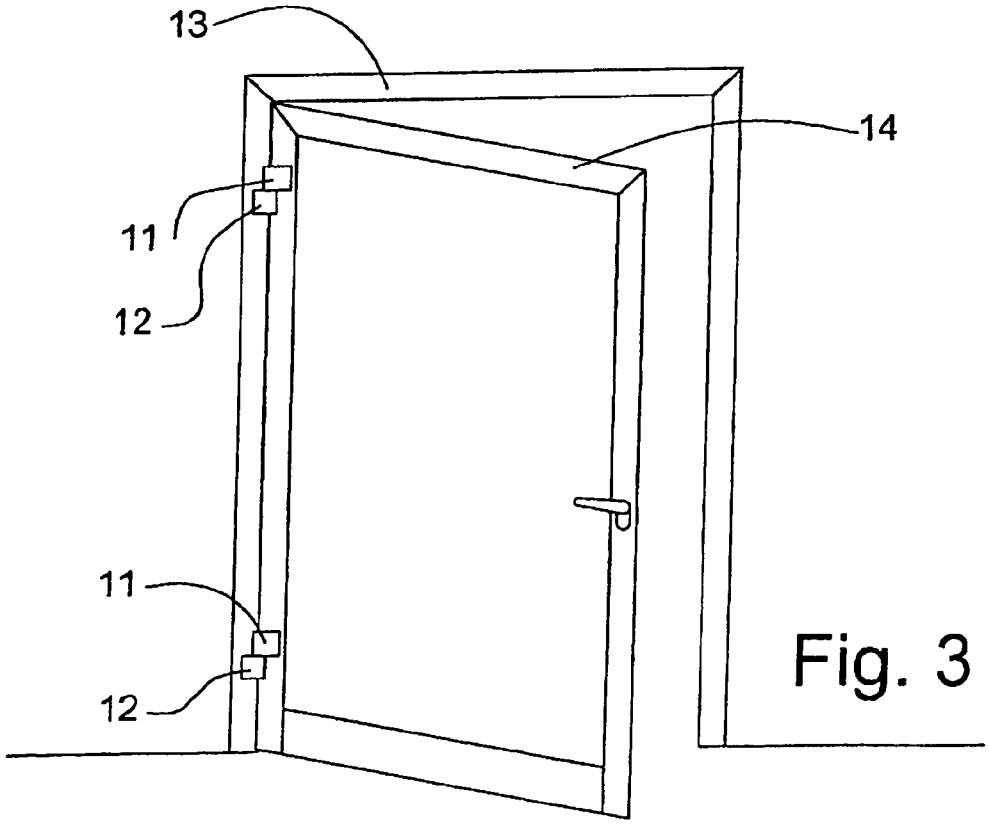
FIG. 3 shows a door leaf fit with two hinges, according to one embodiment of the disclosure.

Referring now to the drawings and, more particularly, to FIGS. 1-15, there is shown generally a specific, illustrative adjustable hinge 10 for doors, windows or the like according to various aspects of the disclosure. In one embodiment, illustrated generally in FIG. 1, the hinge comprises two hinge bodies, an upper body 11 and a lower body 12, respectively, for respective attachment to a fixed or stationary frame 13 and a mobile frame or leaf 14 of the door or window. The upper and lower bodies are pivotally connected to one another by a hinge pin 15. Generally speaking, the terms "upper" and "lower", "right" and "left", as used in this disclosure, are intended to refer, for example, to the corresponding sides of the drawings in which the hinge of the disclosure is shown.

Both upper body 11 and the lower body 12 are provided with suitable member 16, e.g., screws 16*a* and plate 16*b* for covering the screws, to secure it, respectively, to leaf 14 and frame 13 of the door or window. Plate 16*b* is preferably attached using additional screws 16*c* (see FIG. 5) accessible to the user from the inner side of the door, thereby also providing protection from unlawful entry such as by a burglar.

Figure 5:
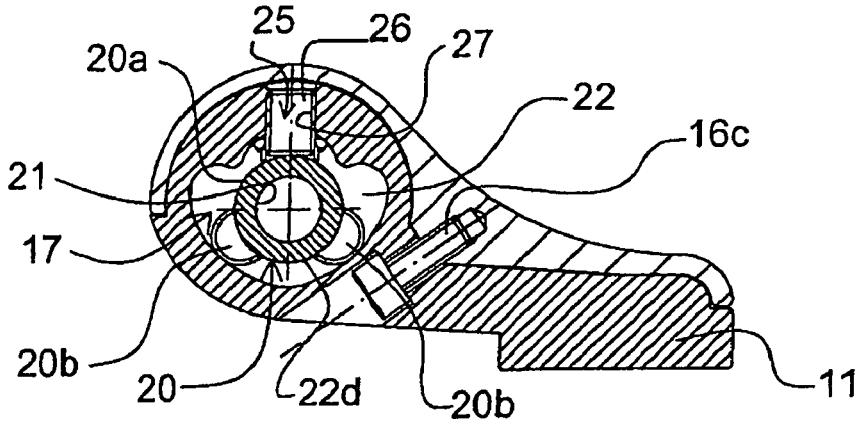
FIG. 5 is a sectional plan view of the upper body of the hinge set forth in FIG. 4.
Figure 6:
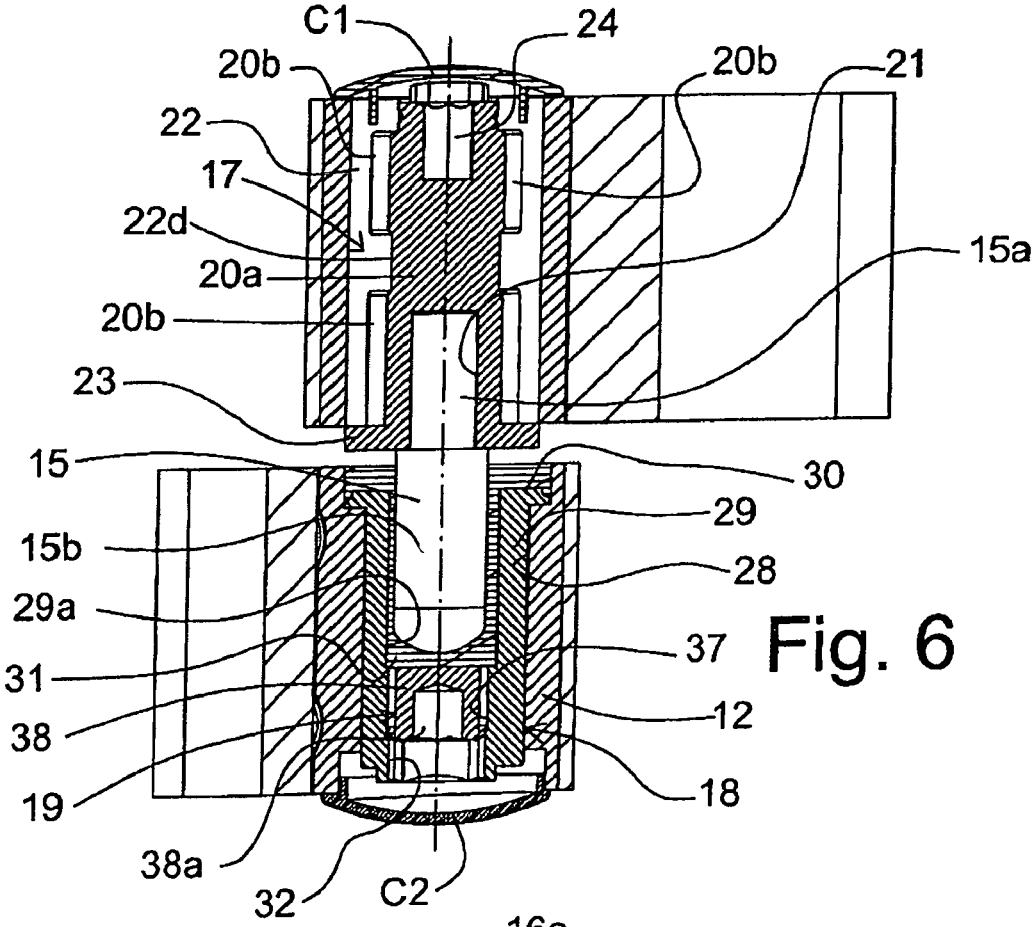
FIG. 6 is an axial, front sectional view of the hinge illustrated in FIGS. 1-5.

First member 17, shown generally in FIGS. 5 and 6, associated with upper hinge body 11, is provided for adjusting the mutual positions of the hinge bodies in a direction generally crosswise to the axis of pin 15. More particularly, as indicated by the letter "Z" in FIGS. 8-11, this direction is substantially parallel to the plane of the door or window leaf. For purpose of illustration, adjustment in the Z direction is hereinafter also referred to as "lateral adjustment".

Figure 4:
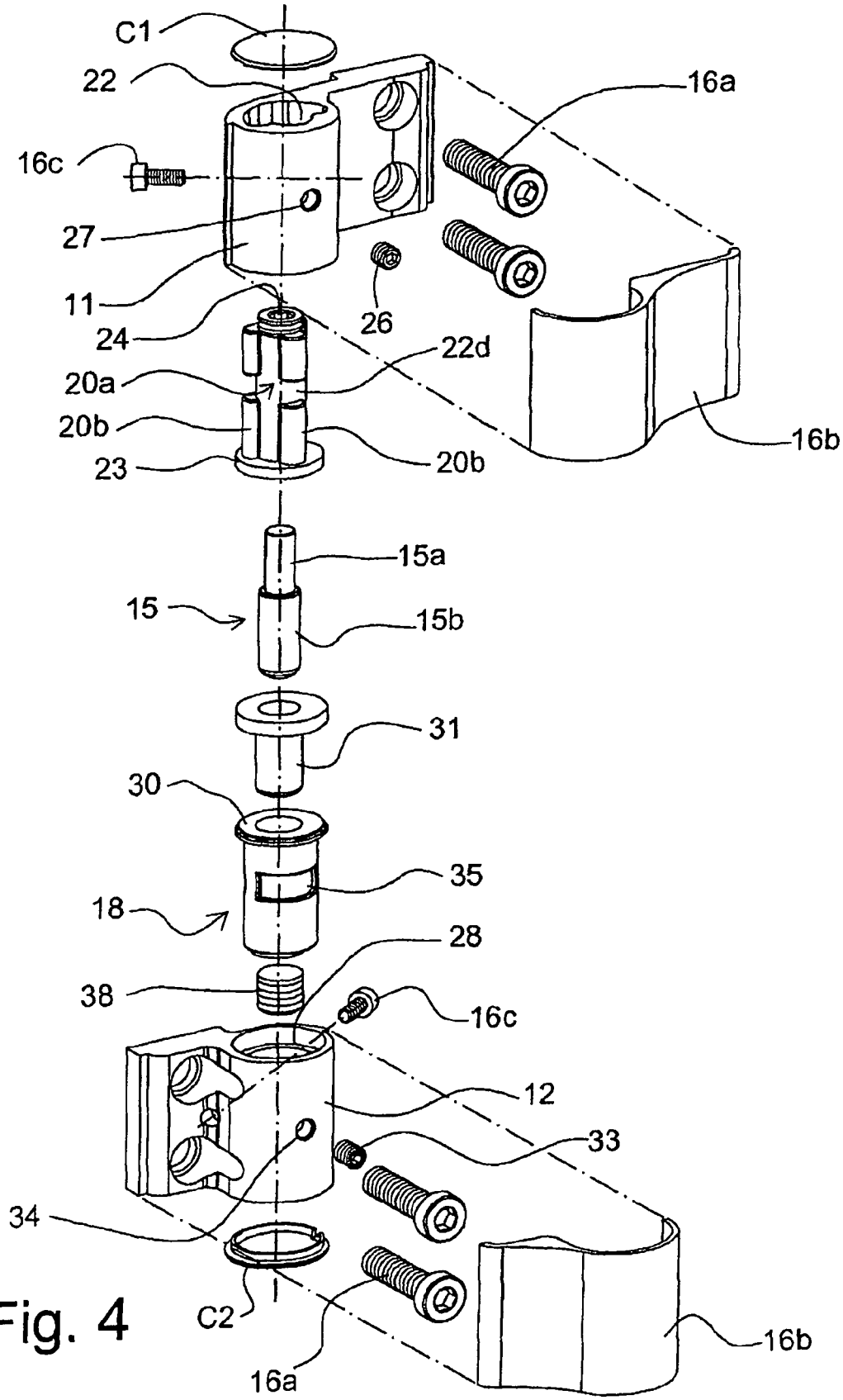
FIG. 4 is an exploded axonometric view of a hinge, in accordance with the disclosure.

As illustrated in FIG. 4, second member 18, associated with lower hinge body 12, is provided for adjustment of the mutual positions of the hinge bodies and in a direction substantially orthogonal to the plane of the door or window leaf 14 (hereinafter also referred to as "orthogonal adjustment"). Third member 19, also associated with the lower body, is provided, in turn, for adjusting the mutual positions of the hinge bodies in the direction of the axis of the hinge pin (hereinafter "vertical adjustment").

First member 17 for lateral adjustment comprise a sleeve 20 defining an internal seat 21 (e.g., a circular blind hole) for coaxially coupling, such as by interference fit, with upper part 15*a* of revolving pin 15, and an outer lateral surface for coupling with a corresponding housing 22 passing through the upper body 11. Optionally, the pin and sleeve may be constructed as a single piece or, in any case, be monolithic.

The sleeve comprises, for example, a cylindrical body 20a which extends over the full length of the upper body. A flange 23 abutting a lower edge of the upper body projects from a lower end of cylindrical body 20*a*. At the other end of sleeve 20, opposite flange 23, blind hole 24 is formed, the hole being configured so as to form, e.g., a hexagon-shaped seat for engagement with a wrench.

The lateral surface of cylindrical body 20*a* is configured so as to provide three distinct portions 20*b* of contact with walls of housing 22. According to one arrangement, contact portions 20*b* are longitudinal projections having a semicylindrical shape, an axis of which is parallel to the axis of the cylindrical body. As set forth generally in FIGS. 1-15, the longitudinal projections are equidistant from one another about the cylindrical body, i.e., they are spaced at an angle of about 120°.

Figure 15:
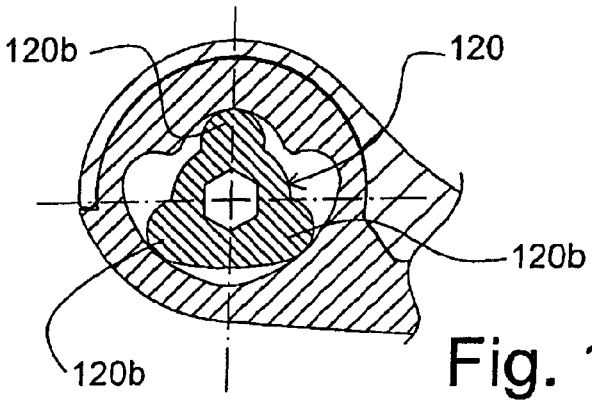
FIG. 15 is a variation of the hinge adjusting sleeve illustrated generally in FIGS. 1-14.

According to a further arrangement, illustrated generally in FIG. 15, a sleeve 120 is provided, such sleeve being a variation of but considered generally equivalent to sleeve 20 described above. Notably, although sleeve 120 is formed with three projections 120*b*, two of the projections are radiused relative to one another.

Desirably, sleeve 20 is pivotable axially in housing 22. The form of the housing is such that, while the sleeve remains in constant contact with the housing walls during its rotation to change position, it may occupy substantially any position along a limited length in a direction parallel to the plane of the door or window leaf, i.e., the direction Z of lateral adjustment of first member 17. An arrangement of this general description is shown, for example, in FIGS. 8, 9, 10 and 11.

Specifically, the shape of the housing is symmetrical relative to a longitudinal plane parallel to the axis of pin 15. Also, the housing is formed with three different sliding grooves for respective projections 20*b*; in particular, two first sliding grooves 22*a* that are symmetrical to one another relative to the longitudinal plane, and one second groove 22*b* that extends between first grooves 22*a*. The two first grooves are radiused relative to one another at adjacent ends, whereas at the opposite ends abutments 22*c* are provided for the respective projections 20*b*. The abutments correspond to ends of the pivotal stroke of sleeve 20, i.e., limit stops for adjustment in the direction of the plane of the door or window leaf 14.

Upper body 11 comprises a device 25 for reversibly locking the sleeve 20 inside housing 22 by exerting a selected force in a defined locking direction, for example, crosswise to the housing (and orthogonal to the lateral adjustment direction Z) and lying in its plane of symmetry. As best seen in FIGS. 8, 9, 10 and 11, and as explained in greater detail below, the plane/direction corresponds to the position "0" of the sleeve inside the housing.

Locking device 25 includes, for instance, a threaded dowel 26 (see FIGS. 4 and 5) inserted through a corresponding counter-threaded through-hole 27 on a side of the upper hinge body. The dowel extends into the housing and abuts the side of cylindrical body 20*a*, at a recessed area or gap 22*d* at an intermediate position of projections 22*a*.

When locking dowel 26 pushes against the cylindrical body, at least two projections 20*b* exert a thrusting action or force on an inside wall of the housing, i.e., on grooves 22*a*, 22*b* in two directions, respectively, incident one another. In other words, the force exerted by the dowel is distributed in two, non-parallel directions. For example, the projections are spaced angularly by 120°; in FIG. 8, the arrows showing the thrusting action or force on the projections for locking the sleeve are indicated by the letter "S"). In this manner, the locking dowel takes up any slack due to machining tolerances in the coupling between the sleeve and the housing.

In operation, lateral adjustment of the hinge is accomplished, as follows. Initially, sleeve 20 is coaxial to and integral with hinge pin 15, the pin being rotatable inside lower hinge body 12. Using a wrench in the hexagon-shaped seat in blind hole 24, the user rotates the sleeve (It is noted that because the sleeve is attached to the pin, which is, in turn, pivotally connected to the hinge body associated with the stationary door frame, translation of the sleeve is restricted). The particular shape of housing 22 ensures that projections 20*b*, sliding along the housing walls, induce a thrust or force sufficient to achieve a substantial translation of the housing, i.e., of the upper hinge body, in lateral adjustment direction Z (i.e., the direction parallel to the main plane of the door leaf).

Figure 8:
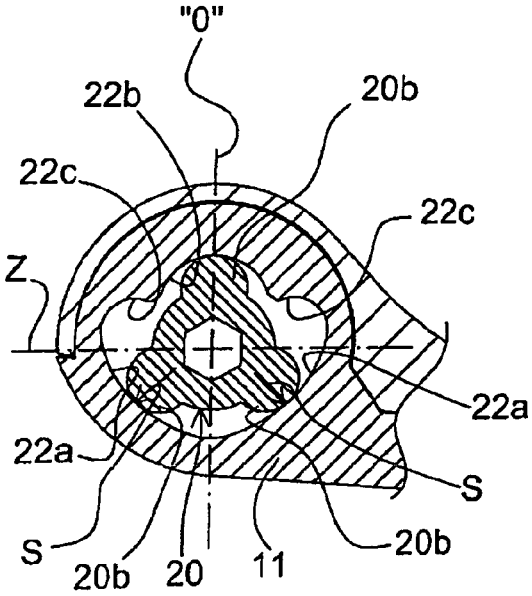
FIG. 8 is a sectional plan view of the upper body with the hinge adjusting sleeve in position "0"

FIG. 8 shows the respective positions of the sleeve and upper hinge body in position "0", that is, in a position of intermediate adjustment in which the three projections 20*a* are in contact with their respective grooves on the inside walls of the housing, and in which the hinge body can still translate to the left or right of the position.

Figure 9:
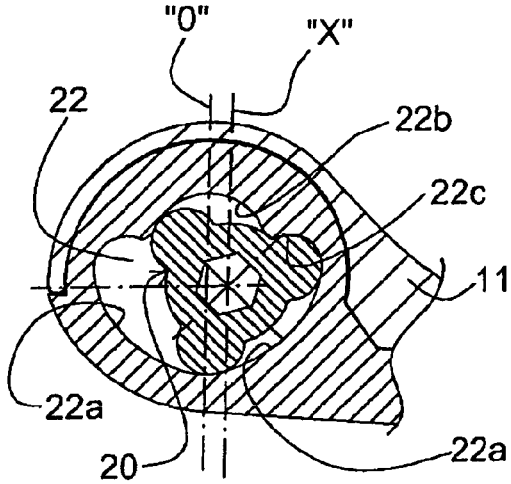
FIG. 9 is a sectional plan view of the upper body with the hinge adjusting sleeve in a position of maximum rightward extension.

According to a further arrangement, as illustrated in FIG. 9, the respective positions of the sleeve and the upper hinge body are in position "X", i.e., after maximum rightward displacement, where one projection 22*a* abuts a corresponding limit stop 22*c*. The axis of pin 15 has been displaced from position "0" to position "X" while sliding in the Z direction. The three projections are in a different position, but always abut the inside surface of the housing.

Figure 10:
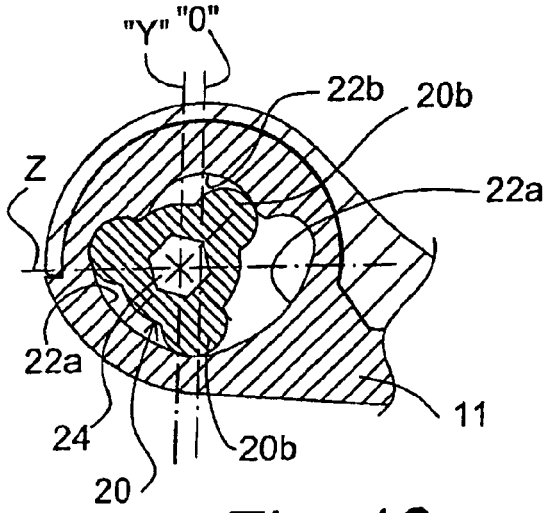
FIG. 10 is a sectional plan view of the upper body with the hinge adjusting sleeve in a position of maximum leftward extension.

Similarly, FIG. 10 shows the respective positions of the sleeve and the upper hinge body in position "Y", i.e., after maximum leftward displacement, where one projection 22*a* abuts corresponding limit stop 22*c*. The axis of the pin has been displaced from position "0" to position "Y" while sliding in the Z direction. The three projections are in another position, but always abut the inside surface of the housing.

Figure 11:
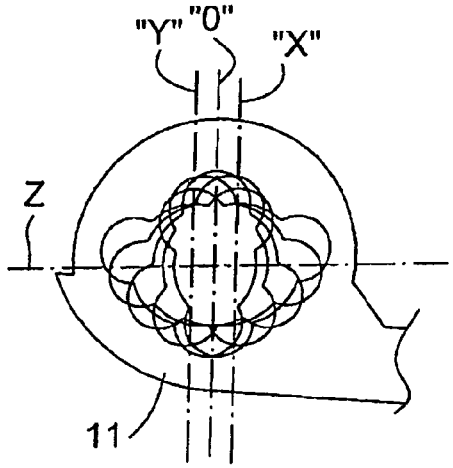
FIG. 11 shows schematically a plan view of the upper body with the hinge adjusting sleeve in various adjustment phases.

As those skilled in the art will appreciate, the sleeve and upper hinge body may be adjusted to any of a number of other intermediate positions, exemplary mutual positions of which being illustrated schematically in FIG. 11.

Once the upper hinge body has been positioned suitably relative to the sleeve, the locking dowel is tightened against the sleeve, thereby preventing any mutual movements of the sleeve and housing, and taking up the slack in the coupling between the two. Finally, a small cap C1 is fit on the housing to cover the same.

Optionally, the respective positions of the sleeve and housing may be adjusted continuously and not stepwise, such that they occupy any intermediate lateral adjustment position of the hinge.

It is emphasized that (i) second adjustment member 18 is advantageously associated with lower hinge body 12 for adjusting the respective positions of the respective hinge bodies in a direction substantially orthogonal to the plane of the door leaf ("orthogonal adjustment"), and (ii) third adjustment member 19 is associated therewith for adjustment of the hinge vertically. Preferably, first lateral adjustment member 17, second orthogonal adjustment member 18, and third vertical adjustment member 19 each are substantially independent of one another.

Figure 7:
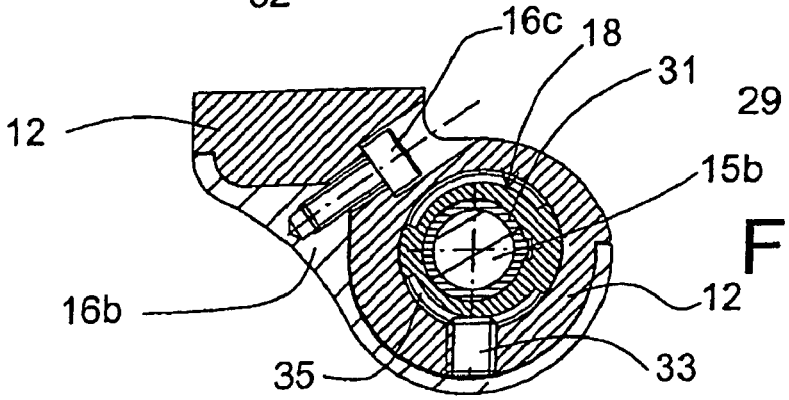
FIG. 7 is a sectional plan view of the lower body of the hinge.

As shown in FIGS. 4, 6 and 7, the second orthogonal adjustment member include a cylindrical cavity 28 passing through lower hinge body 12 along an axis parallel to the axis of pin 15. The cylindrical cavity houses a sleeve 29 fit with a flange 30 that abuts the upper end of the lower hinge body.

Figure 12:
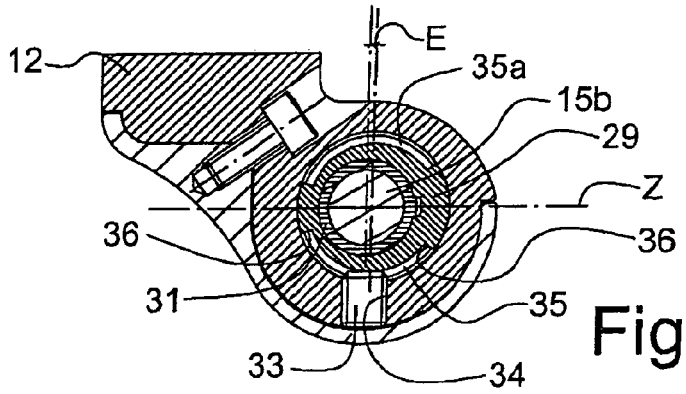
FIGS. 12, 13 and 14 are sectional plan views, indicating three different positions of inward or outward adjustment of the hinge.

Sleeve 29 is formed with a vertically-extending through-hole 29*a* which, in turn, contains a bushing 31—constructed, for instance, of a self-lubricating plastic material—pivotally housing lower part 15*b* of the revolving pin. Bushing 31 is eccentric relative to sleeve 29. The eccentricity between the axis of the bushing and pin, and the axis of the sleeve, is designated generally in FIG. 12 by the letter "E". As shown in FIG. 12, the axis of the bushing and pin, and the axis of the sleeve, lie in the same plane, which coincides with the direction "Z", i.e., a direction parallel to the plane of the corresponding door leaf (when in a closed position) passing through the axis of the pin.

A lower opening 32 in through-hole 29*a* is desirably shaped like a hexagon to enable the sleeve to be rotated using a suitable wrench. Bushing 31, upon which pin 15 is supported and rotates, is substantially integral with sleeve 29 such that, when appropriate force is applied by the user to the hexagon-shaped lower opening, the bushing is also rotates as well.

Figure 13:
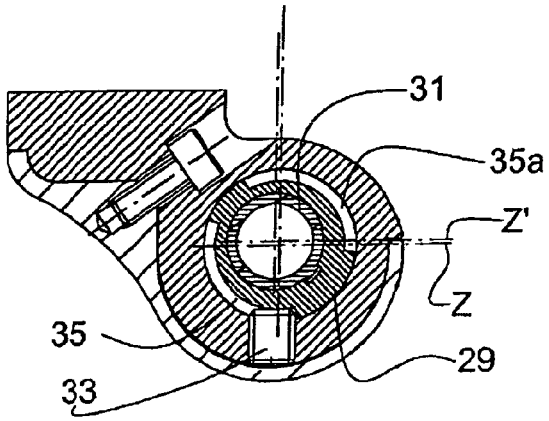
Figure 14:
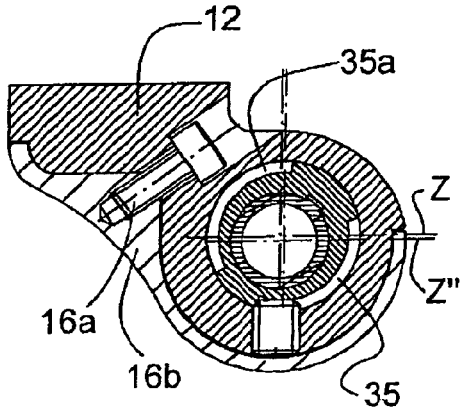

Referring now to orthogonal adjustment of the hinge, FIG. 12 shows the hinge in an intermediate position at which its eccentricity E is aligned with the direction Z. From the intermediate position, rotation of the sleeve induces angular displacement of the eccentricity and, in turn, rotation of the axis of the pin along a circular path having a radius E. Depending on the direction of rotation, the axis of the pin may be displaced either forward or backward in a direction generally orthogonal to the Z direction, that is, it may be brought closer to or further away from the door frame. As illustrated in FIG. 13, upon clockwise rotation of the sleeve, the pin is displaced a distance (Z') from the direction Z, toward the door frame. FIG. 14 shows a counterclockwise rotation of the sleeve such that the pin is displaced a distance (Z") from the direction Z, away from the door frame.

A screw 33 preferably engages sleeve 29 through a counter-threaded through-hole 34 in a side of lower hinge body 12. One end of the screw is inserted in a semicircular groove 35 on the lateral surface of the sleeve and abuts the sleeve so as to lock it in position and take up any slack in the coupling between cylindrical cavity 28 and the sleeve. Ends 36 of the groove define limit stops for rotation of the sleeve and, hence, the ends of the stroke of orthogonal adjustment of the hinge. A semicircular groove 35*a* is also provided on the sleeve, symmetrical with groove 35 relative to a vertical plane, thereby enabling the sleeve to be used for both right and left opening hinges.

An internal lower portion 37 of through-hole 29*a* is threaded for coupling with a small counter-threaded cylinder 38, a blind backing plate 38*a* being provided with a hexagonal shape for allowing insertion of a suitable wrench. The bushing and, therefore, the pin, rests on the small cylinder. Together, the small cylinder and internal lower portion constitute the third adjustment member for vertical hinge adjustment 19. By acting on the small cylinder, the bushing with pin 15, and consequently upper hinge body 11, is displaced upwardly or downwardly.

Once the orthogonal and vertical adjustments are made, a lower cap C2 is inserted to cover cylindrical cavity 28.

In this manner, the hinge, according to various aspects of this disclosure, compensates effectively for slack upon coupling of the hinge components so as to avoid any malfunction or breakage. Indeed, the novel structure of the hinge enables the respective positions of the hinge bodies to be adjusted independently, thereby taking up any slack due to manufacturing tolerances and, in turn, providing greater durability of the hinge assembly. A further benefit of the adjustable hinge is its provision of a readily accessible adjustment device.

Overall, a hinge, according to various aspects of this disclosure, not only enables extraordinarily precise lateral adjustment of the respective hinge bodies' positions, but is also effective in taking up any slack. These advantages occur both because lateral adjustment is not performed in a stepwise fashion and because slack is taken up "automatically" with the locking of the hinge bodies in the required position. The range of adjustment is extremely precise because of the provision of limit stops on the adjustment elements. In this manner, any problems due to errors in hinge adjustment are avoided.

As will be understood by those skilled in the art, components of the adjustable hinge described herein may advantageously be replaced by other, technically equivalent elements, without departing from the scope of the invention. In addition, any materials of construction may be used and the components may be of any shape and size, according to need and the state of the art; provided, however, that they are compatible with the use intended herein.

Furthermore, where characteristics and techniques mentioned in any of the claims below are followed by reference signs, such have been included merely as an example and for the sole purpose of facilitating reading of the claims and, consequently, shall not be construed to limit the interpretation of any element they may identify.

Indeed, numerous modifications, alterations and variants may be appreciated based on a review of this disclosure. These changes and additions are intended to be within the scope and spirit of the disclosure as defined by the following claims.

What is claimed is:

1. An adjustable hinge comprising:

a plurality of hinge bodies for attachment to a fixed frame and to a mobile frame, respectively, of a door or window, a revolving pin for pivotally connecting the hinge bodies to one another, and a member for adjusting shared positions of the hinge bodies in a direction generally perpendicular to the axis of the pin, the adjustment member comprising a sleeve, associated axially with the pin, defining an external lateral surface for coupling with a corresponding housing defined in a first of the hinge bodies, the sleeve being pivotal inside the housing such that, while it remains in relatively constant contact with the walls of the housing during its rotation to change position, it may occupy substantially any position required along a limited length of the perpendicular adjustment direction a reversible locking member being provided for locking the sleeve in the positions it occupies inside the housing upon application of a thrusting force in a selected locking direction, wherein the sleeve has at least three distinct portions of contact with the walls of the housing, spaced angularly from one another, and when the locking member is engaged, at at least two of the distinct contact points a thrusting force is exerted, in directions incident to one another, on respective portions of the walls so as to accommodate for slack between the sleeve and the housing in incident directions, the thrusting force exerted by the locking member being separated into non-parallel directions coinciding with the at least two of the distinct contact points, and wherein the shape of the housing is symmetrical relative to a selected longitudinal plane generally parallel to the axis of the pin inside the sleeve, and is formed with three different sliding grooves for corresponding contact points, respectively two first grooves symmetrical with one another relative to the plane, and one second intermediate groove between the two first grooves, the two first grooves being radiused at adjacent ends, while having at opposite ends abutments for the respective contact points providing stops for rotation of the sleeve, the locking direction defined by the reversible locking of the sleeve lying in a plane of symmetry of the two first grooves.

2. The hinge set forth in claim 1, wherein the sleeve has a cylindrical body from which longitudinal projections extend laterally, defining the distinct portions of contact with the walls of the cavity, a flange at one end of the cylindrical body for abutting the first hinge body at the opening of the housing, the projections having a substantially semicylindrical cross-section with an axis parallel to the axis of the cylindrical body, the projections further having a gap at an intermediate position that serves as a seat for a locking dowel of the reversible locking member, a seat being provided at one end of the cylindrical body for causing rotation of the sleeve with the aid of a wrench.

3. The hinge set forth in claim 1, wherein the first hinge body corresponds to the upper hinge body, the sleeve being mounted coaxially to the upper part of the pin, the perpendicular adjustment direction being substantially parallel to the plane of the mobile frame to which the hinge is attached with the aid of a mounting member.

4. The hinge set forth in claim 3, further comprising a second member for adjusting the shared positions of the two hinge bodies in a direction substantially orthogonal to the plane of the mobile frame to which the hinge is attached, the second member being independent of the parallel adjustment member.

5. An adjustable hinge comprising:

a plurality of hinge bodies for attachment to a fixed frame and to a mobile frame, respectively, of a door or window, a revolving pin for pivotally connecting the hinge bodies to one another, and a member for adjusting shared positions of the hinge bodies in a direction generally perpendicular to the axis of the pin, the adjustment member comprising a sleeve, associated axially with the pin, defining an external lateral surface for coupling with a corresponding housing defined in a first of the hinge bodies, the sleeve being pivotal inside the housing such that, while it remains in relatively constant contact with the walls of the housing during its rotation to change position, it may occupy substantially any position required along a limited length of the perpendicular adjustment direction a reversible locking member being provided for locking the sleeve in the positions it occupies inside the housing upon application of a thrusting force in a selected locking direction, wherein the sleeve has at least three distinct portions of contact with the walls of the housing, spaced angularly from one another, and when the locking member is engaged, at at least two of the distinct contact points a thrusting force is exerted, in directions incident to one another, on respective portions of the walls so as to accommodate for slack between the sleeve and the housing in incident directions, wherein the first hinge body corresponds to the upper hinge body, the sleeve being mounted coaxially to the upper part of the pin, the perpendicular adjustment direction being substantially parallel to the plane of the mobile frame to which the hinge is attached with the aid of a mounting member, the hinge further comprising a second member for adjusting the shared positions of the two hinge bodies in a direction substantially orthogonal to the plane of the mobile frame to which the hinge is attached, the second member being independent of the parallel adjustment member, and wherein the second adjustment member comprises a cylindrical cavity, passing through the lower hinge body, along an axis lying generally parallel to the axis of the pin, and inside the cylindrical cavity a sleeve is housed having a vertically extending through hole therein, which, in turn, contains a bushing that houses pivotally and concentrically the lower part of the revolving pin, the bushing housing the pin being mounted eccentrically relative to the sleeve, the lower opening of the through hole in the sleeve being shaped for coupling with a wrench suitable for inducing the rotation of the sleeve.

6. The hinge set forth in claim 5, wherein a screw inserted through a counter-threaded through hole formed in the side of the lower body engages the sleeve, and one end of the screw is inserted in a semicircular groove formed in the lateral surface of the sleeve so as to bear against the collar and, thereby, lock the latter in position and compensate for slack in the coupling between the cylindrical cavity and the sleeve, the ends of the groove defining the stops for rotation of the sleeve.

7. The hinge set forth in claim 6, wherein a further semicircular groove is formed in the sleeve, symmetrically located relative to the semicircular groove in relation to a vertical plane passing through the sleeve axis.

8. The hinge set forth in claim 1, further including a third member for vertical adjustment of the shared positions of the hinge bodies.

9. An adjustable hinge comprising:

a plurality of hinge bodies for attachment to a fixed frame and to a mobile frame, respectively, of a door or window, a revolving pin for pivotally connecting the hinge bodies to one another, and a member for adjusting shared positions of the hinge bodies in a direction generally perpendicular to the axis of the pin, the adjustment member comprising a sleeve, associated axially with the pin, defining an external lateral surface for coupling with a corresponding housing defined in a first of the hinge bodies, the sleeve being pivotal inside the housing such that, while it remains in relatively constant contact with the walls of the housing during its rotation to change position, it may occupy substantially any position required along a limited length of the perpendicular adjustment direction a reversible locking member being provided for locking the sleeve in the positions it occupies inside the housing upon application of a thrusting force in a selected locking direction, wherein the sleeve has at least three distinct portions of contact with the walls of the housing, spaced angularly from one another, and when the locking member is engaged, at at least two of the distinct contact points a thrusting force is exerted, in directions incident to one another, on respective portions of the walls so as to accommodate for slack between the sleeve and the housing in incident directions, wherein the third member for vertical hinge adjustment comprises a relatively small counter-threaded cylinder engaged with a threaded internal lower portion of the sleeve through hole, a bushing with the pin resting against the counter-threaded small cylinder.

10. The hinge set forth in claim 5, wherein the third member for vertical hinge adjustment comprises a relatively small counter-threaded cylinder engaged with a threaded internal lower portion of the sleeve through hole, the bushing with the pin resting against the counter-threaded small cylinder.

* * * * *